US006290533B1

(12) United States Patent
Major

(10) Patent No.: US 6,290,533 B1
(45) Date of Patent: Sep. 18, 2001

(54) FLASHLIGHT PLUG

(76) Inventor: Jane Major, 500 W. Middlefield Rd. #97, Mt. View, CA (US) 94043

( * ) Notice: Subject to any disclaimer, the term of this patent is extended or adjusted under 35 U.S.C. 154(b) by 11 days.

(21) Appl. No.: 09/679,741

(22) Filed: Oct. 5, 2000

Related U.S. Application Data

(60) Provisional application No. 60/158,185, filed on Oct. 5, 1999.

(51) Int. Cl.[7] ..... H01R 3/00

(52) U.S. Cl. ..... 439/490; 439/488; 439/910; 439/106; 362/257; 362/253

(58) Field of Search ..... 439/488, 490, 439/910, 76.1, 106; 362/95, 226, 116, 257, 253

(56) References Cited

U.S. PATENT DOCUMENTS

| | | | | |
|---|---|---|---|---|
| 3,500,293 | | 3/1970 | Cocco | 339/113 |
| 3,733,576 | | 5/1973 | Cooper | 339/14 P |
| 3,890,030 | | 6/1975 | McDaniel | 339/113 L |
| 4,276,582 | * | 6/1981 | Burnett | 362/116 |
| 4,350,407 | | 9/1982 | Tong | 339/113 L |
| 4,606,597 | | 8/1986 | Bielefeld | 339/113 L |
| 4,812,827 | | 3/1989 | Scripps | 340/693 |
| 4,834,664 | | 5/1989 | Lin | 439/145 |
| 5,207,594 | | 5/1993 | Olson | 439/490 |
| 5,320,560 | | 6/1994 | Fladung | 439/490 |
| 5,409,398 | | 4/1995 | Chadbourne et al. | 439/490 |
| 5,470,252 | | 11/1995 | Fladung | 439/490 |
| 5,690,509 | | 11/1997 | Eisenbraun | 439/490 |
| 5,863,364 | | 1/1999 | Lin et al. | 156/73.1 |
| 6,078,113 | * | 6/2000 | True et al. | 307/147 |

* cited by examiner

*Primary Examiner*—Paula Bradley
*Assistant Examiner*—Ann McCamey
(74) *Attorney, Agent, or Firm*—Thomas Schneck

(57) ABSTRACT

An electrical plug incorporates a light beam between the prongs of the plug. The light beam is forwardly directed such that the plug can illuminate a socket where the plug is to be inserted. The plug body includes a circuit board having a light, resistor, battery and switch. A first type of switch that is used includes a push button attached to a spring and contact pads mounted on the circuit board, wherein when the button is pressed the spring electrically connects contact pads within the circuit thus closing the circuit and activating the light. A second type of switch that is used incorporates contact pads and a flexible cover having a pair of electrically conductive leaves hingedly attached to its underside. When an exterior surface above the cover is pressed the leaves move upward and electrically connect contact pads within the circuit thereby closing the circuit and activating the light.

13 Claims, 4 Drawing Sheets

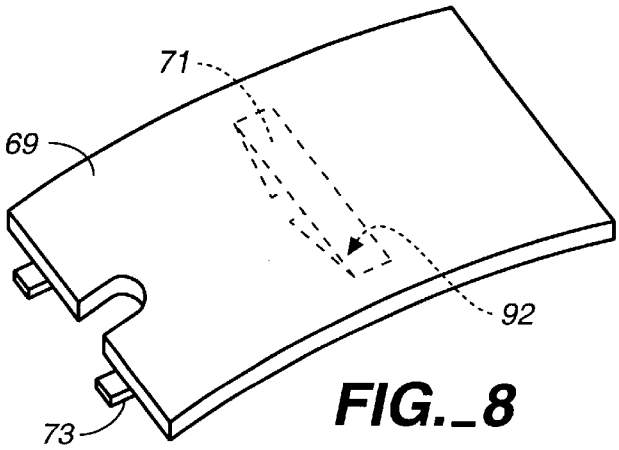
FIG._8
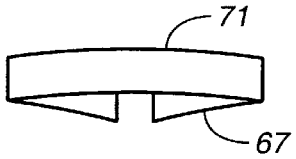
FIG._9A
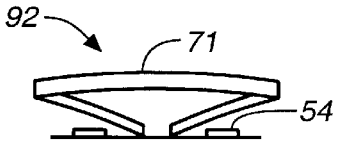
FIG._9B
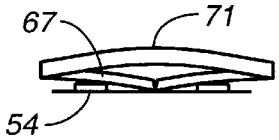
FIG._9C
FIG._10
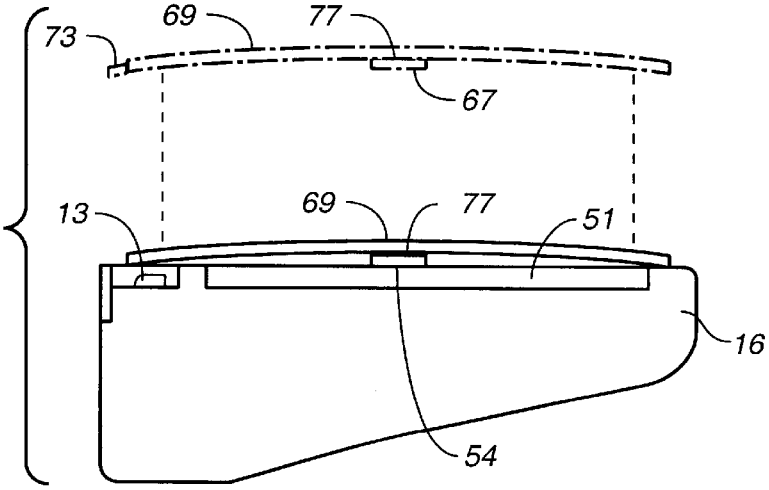

FLASHLIGHT PLUG

CROSS-REFERENCED TO RELATED APPLICATION

This application claims the benefit of U.S. Provisional application Ser. No. 60/158,185 filed Oct. 5, 1999.

BACKGROUND OF THE INVENTION

The invention pertains generally to the field of electrical devices and more particularly to the incorporation of a light within the body of an electrical plug attached to an electrical device such that a light beam projected from the light and directed forwardly between the prongs of the plug, illuminates a socket where the plug is to be inserted.

U.S. Pat. No. 4,350,407 shows dual lamps mounted in a plug serving the purpose of fuses. These lamps are not battery powered and would not be on in the absence of electricity.

A number of patents show a plug having an internal lamp for indicating the condition of circuitry. For example, U.S. Pat. No. 5,690,509 shows an automotive cigarette lighter plug with an internal lamp, which is energized when the plug is drawing current. The lamp may be viewed through a peripheral lens. U.S. Pat. No. 5,207,594 shows a power extension cord with a lamp in the plug. A translucent body for the plug allows the lamp to be seen when the cord is carrying current. U.S. Pat. No. 4,384,664 shows a plug with a built-in fuse and an electrical lamp indicating the fuse condition. U.S. Pat. No. 5,409,398 shows a plug having a light that becomes lit while electrical energy is fed through the plug. A peripheral lens allows viewing of the lamp.

U.S. Pat. Nos. 4,606,597; 5,863,364; 5,470,252 and 5,320,560 all show plugs with built-in lamps which may be viewed when the plug is carrying electricity.

Additionally, U.S. Pat. Nos. 3,890,030 and 3,733,576 show a neon lamp attached to a plug as a safety indicator. In both cases, the lamp appears to face sideways so that a person can view the lamp when the plug is in the socket.

The present invention helps to avoid accidents by allowing a user to find an electrical socket in the dark. Therefore, it is an object of the present invention that an electrical plug incorporates a light between the prongs of the plug directing a light beam forwardly between the prongs of the plug such that the plug can illuminate a socket where the plug is to be inserted.

It is a further object of the invention to incorporate a switch with the plug, such that a user is able to activate the light by accessing the switch controlling the light.

BRIEF DESCRIPTION OF THE DRAWINGS

FIG. 6(*b*) is a side view of the circuit board of FIG. 6.

FIG. 6(*c*) is a top view of the circuit board of FIG. 6 showing an upper coil contacting contact pads present on the circuit board.

FIG. 8 is a perspective view of a cover for the plug of the present invention pictured in FIG. 1 outlining with dotted lines an area and that is pressed down by a user and a pair of leaves beneath the area.

FIG. 9(*a*) is a perspective top view of the area and pair of leaves outlined with dotted lines in FIG. 8.

FIG. 9(*b*) is a perspective side view of the area and pair of leaves outlined with dotted lines in FIG. 8 and contact pads.

FIG. 9(*c*) is a perspective side view of the area and pair of leaves outlined with dotted lines in FIG. 8 and shows the leaves contacting each other and the contact pads of the circuit board of the present invention.

FIG. 10 is a side view of the cover of FIG. 8 in conjunction with the body of the plug of the present invention.

SUMMARY OF THE INVENTION

The invention is an electrical plug that incorporates a light source between the prongs of the plug. The light source directs a light beam forwardly between the prongs of the plug such that the plug illuminates a socket where the plug is to be inserted.

The light source is housed at least partially inside of the plug body. It should be a small light such as a white LED mounted on a circuit board also within the plug body. The circuit board also includes a resistor, a battery, a switch and electrical wiring connecting all of said resistor, battery, light source and switch. In one embodiment, a lens is attached to the body of the plug in front of the light beam so as to focus or diffuse the light beam.

The plug incorporates two types of switches for activating the beam. In a first embodiment, the switch includes a spring, a push button located on the exterior surface of the plug body and a pair of contacts mounted on the circuit board. The push button is connected to the spring. When the button is pressed the spring electrically connects the pair of contact pads, thereby closing the circuit and activating the light.

In an alternative embodiment, a second type of switch is used. The switch includes a flexible plug cover having an underside with a pair of leaves hingedly connected to it and a pair of contacts mounted on the circuit board. When an exterior surface of the cover above the leaves is pressed, the leaves move upwards and contact each other and the pair of contact pads. This establishes a path of electrical communication between the contact pads, closing the circuit and thereby activating the light.

DETAILED DESCRIPTION OF THE INVENTION

Figure 1:
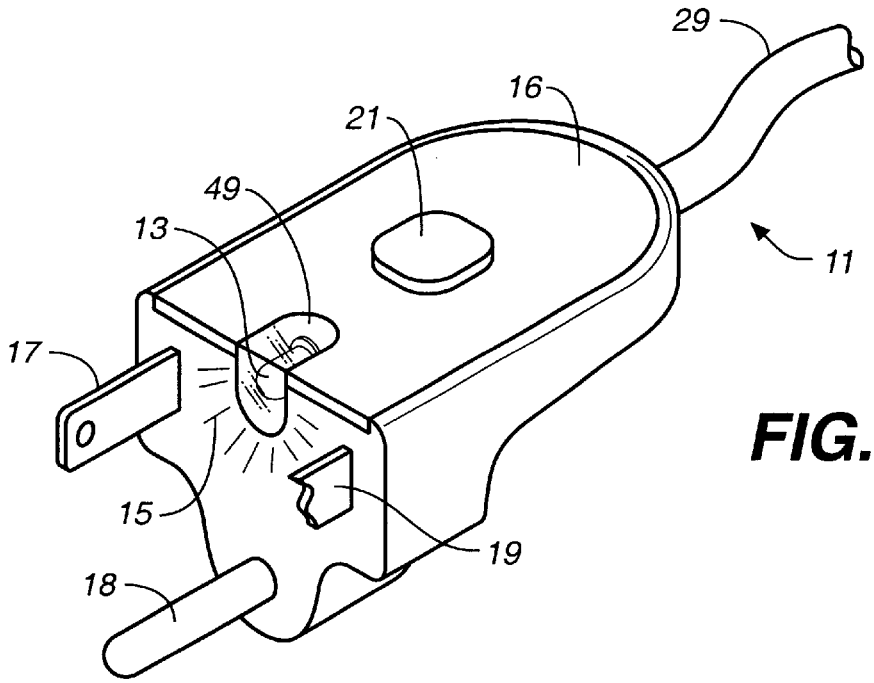
FIG. 1 is a perspective view of the plug of the present invention featuring a light within the body of the plug directing a light beam in a forward direction.

With reference to FIG. 1, plug 11 includes a body 16, a light source 13, push button 21 and prongs 17, 18 and 19 at one end of the body 16 for insertion into a socket (not shown). The body 16 is made from materials such as rubber or plastic typically used in prior art plugs. The number of prongs extending from the body 16 may vary. For example a plug having two prongs, 17 and 19, may be used. The light 13 is housed at least partially within the plug body 16. Light 13 should be a small light such as a white LED that can be projected a distance. Light 13 is mounted on a circuit board (shown in FIGS. 5–7). The push button 21, on an exterior surface of the body 16, activates the light 13 when pressed. A beam of light 15 travels forwardly from the light 13 in between the prongs 17, 18 and 19, illuminating a spot such as a socket that is for example an inch to several feet away. Once the prongs have been inserted within the socket, the light 13 is no longer visible.

Attached to another end of the body 16 of the plug 11 is a cord 29. Cord 29 is a part of an electrical appliance (not shown).

Figure 2:
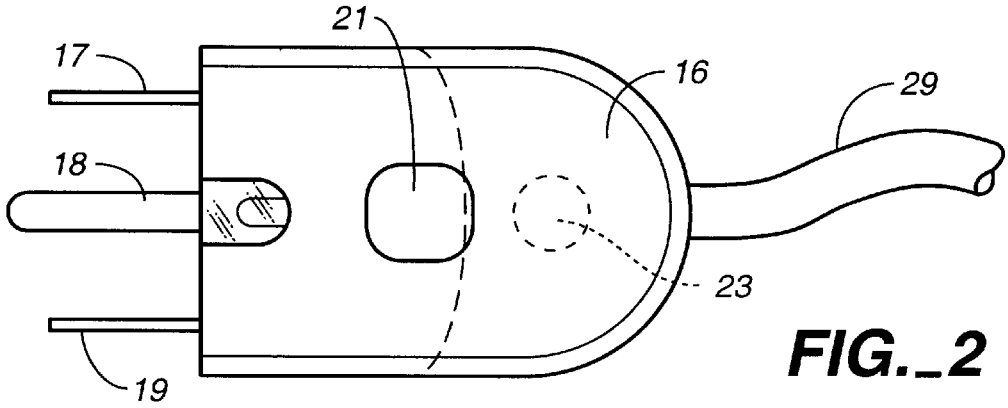
FIG. 2 is a perspective top view of the plug of the present invention pictured in FIG. 1 showing a push button.

In the top view of FIG. 2 a circular outline indicates the position of a battery 23 within the body 16. The battery is seen to be slightly behind the push button 21. The battery is contained within the body 16 of the plug 11 and supplies power, approximately 3 volts, to the plug for operating the light 13. Alternatively, two batteries each having 1.5 volts, or batteries of varying voltage, are also used. Therefore, the light 13 within the body 16 has its own source of power separate from the power supplied from a socket.

Figure 3:
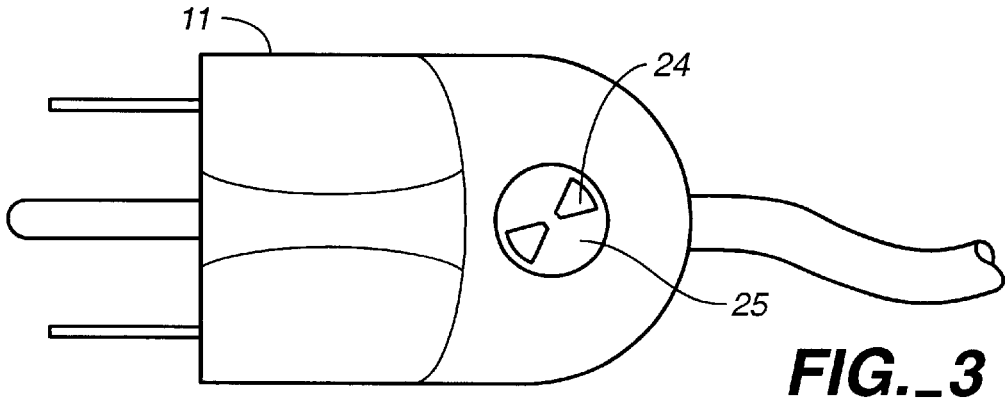
FIG. 3 is a perspective bottom view of the plug of the present invention pictured in FIG. 1 showing a battery access cap.

In the bottom view of FIG. 3, a battery access cap 25 is seen. The access cap is screwed onto a bottom surface of the body 16 of the plug 11 with screws 24. It is unscrewed from the body 16 when the battery 23 is to be replaced.

Figure 4:
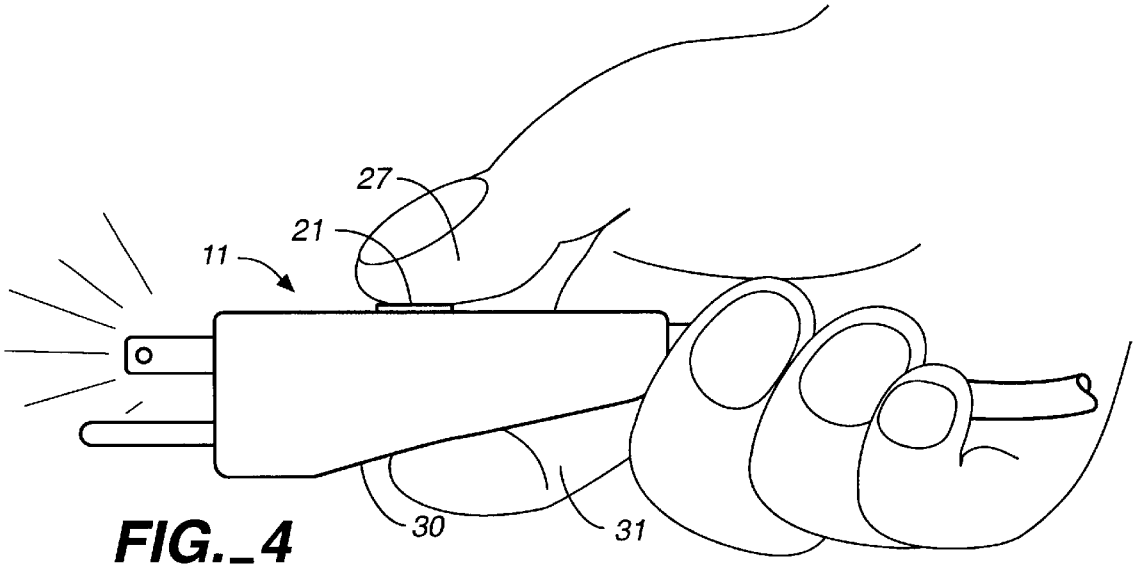
FIG. 4 is a perspective side view of the plug of the present invention pictured in FIG. 1 featuring the positioning of a user's finger and thumb.

FIG. 4 shows the plug 11 held by a user. The body 16 of the plug 11 includes an indented portion 30 on its bottom surface that allows for easy positioning of the user's index finger 31 within the indented portion 30. This assists the user with positioning the plug 11 into the socket. As pictured in FIG. 4 the user's thumb 27 is used to press down on the push button 21. As the user presses down upon the button 21, a spring attached to push button 21 makes contact with a pair of contact pads on a circuit board for closing a circuit between the battery 23 and light 13.

Figure 5:
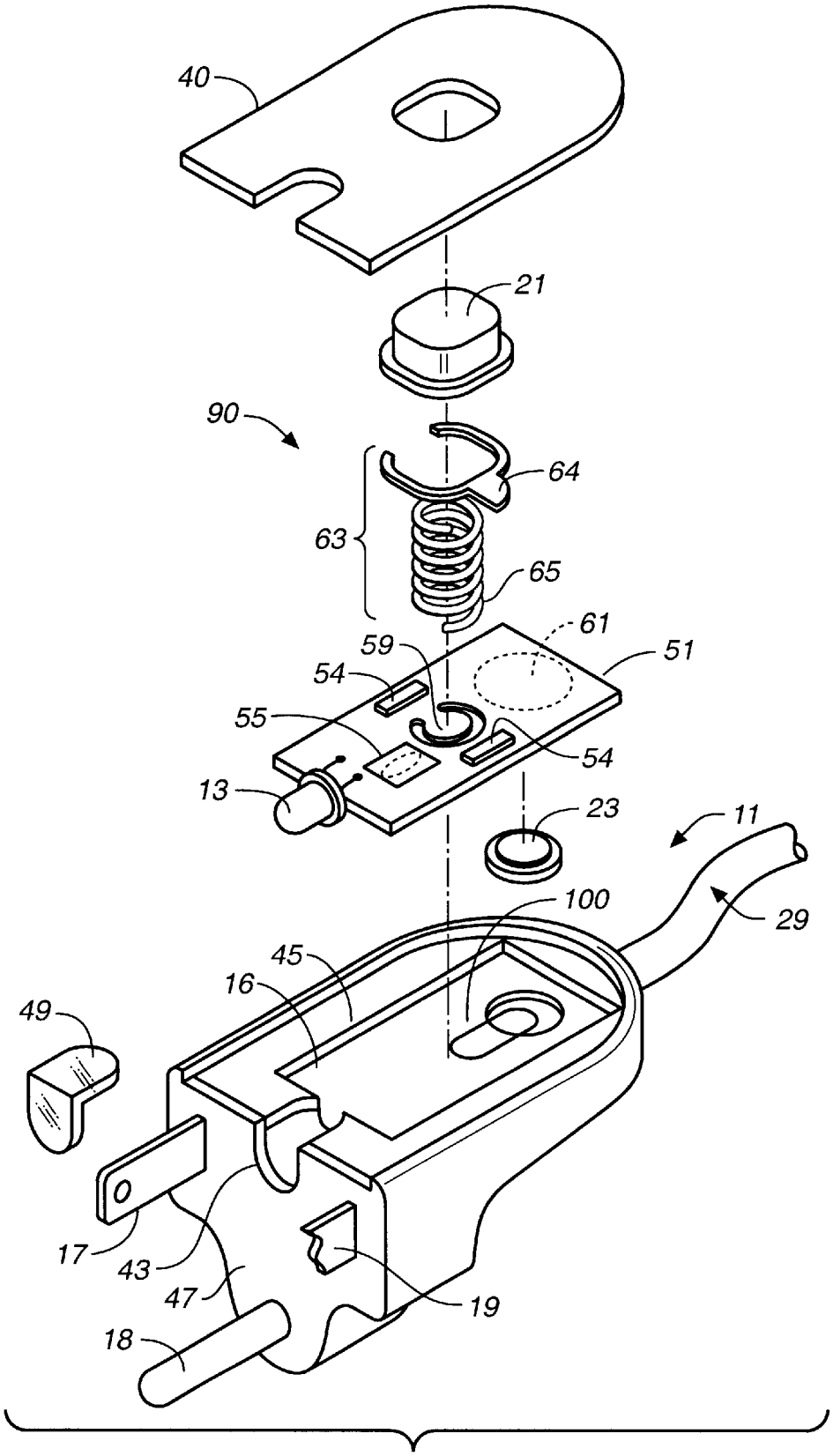
FIG. 5 is a perspective view of the plug of present invention pictured in FIG. 1 featuring the inside of the body of the plug.

FIG. 5 shows a cover 40 removed from the plug 11 revealing the inside of body 16. The body 16 includes a notch 43. The notch 43 extends from a front section of an upper surface 45 of the inside of the body 16 to an upper section of a front surface 47 of the body 16. A lens 49 fits within the notch 43. The lens 49 acts to focus or diffuse the light beam 15 traveling from light 13 such that a spot of a desired size is illuminated. In an alternative embodiment, the lens is not used. Light 13, mounted onto circuit board 51, is located near or within the notch 43 at the front of the body 16. The circuit board 51 is nested within a cavity 100 within the body 16. Circuit board 51 includes a series circuit having the light 13, the battery 23, a resistor 55, and electrically conductive contact pads 54. As shown, contact pads 54 are not in electrical contact with each other. Push button 21 is shown attached to an electrically conductive spring 63. Together, contact pads 54, push button 21 and spring 63 comprise a switch 90. The push button and spring are shown removed from a holding 59 and battery 23 is shown removed from its housing 61.

Figure 6A:
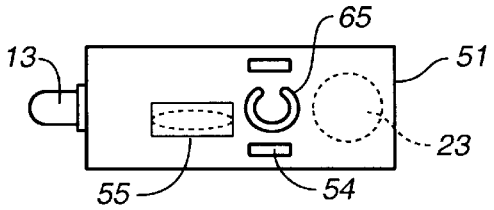
FIG. 6(*a*) is a top view of a circuit board found within the body of the plug.
Figure 6B:
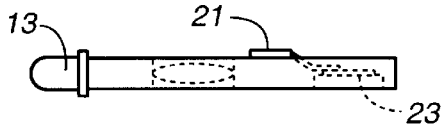
Figure 6C:
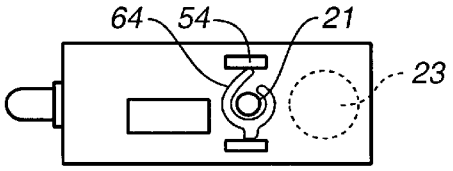

Bottom coil 65 of the spring 63 is found within holding 59 as shown in FIG. 6(*a*) and the battery 23 is within the housing 61 as shown in FIG. 6(*b*). In FIG. 6(*a*) the bottom coil only is depicted so that a top view of it may be seen within the holding. However, when in use, the other coils of the spring and the press button 21 are also attached to it as seen in FIG. 5. The bottom coil does not make contact with the contact pads 54.

The spring coils become wider nearest the button 21. As the button 21 is pressed a wide coil 64 of the spring 63 contacts contact pads 54 and electrically connects contact pads 54 to each other to close the circuit as shown in FIG. 6(*c*). When contact pads 54 are in an electrically connected position relative to each other, the circuit is closed and the light is activated. When contact pads 54 are in an electrically non-connected position relative to each other, the circuit is open and the light is inactive.

Figure 7:
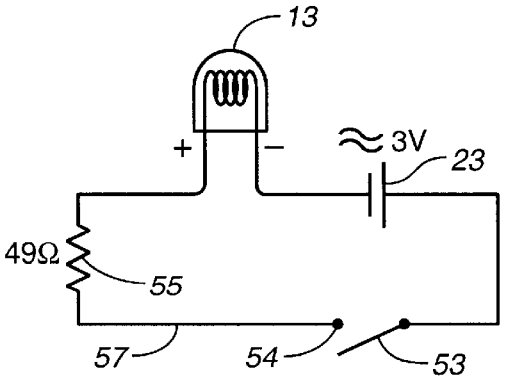
FIG. 7 is a plan view of an electrical series circuit featuring a resistor, battery, light source and switch.

As shown in FIG. 7, electrical wiring 57 connects the light 13, resistor 55, battery 23, contact pads 54 and switch 53 to each other. The resistance used in this example is approximately 49 ohms, however may vary. In one embodiment the resistor 55 is not used. Switch 53 is shown in the off position. When activated, switch 53 closes the electrical circuit thereby activating the light 13 and shining a light beam 15. Switch 53 represents any type of switch that may be used with the present invention. For example, switch 90 shown in FIG. 5 may be used. As the push button 21 of switch 90 is pressed down, spring 63 makes contact with the contact pads 54 on the circuit board.

FIGS. 8, 9(*a*), (*b*) and (*c*) and 10 feature another type of switch. Switch 92 includes contact pads 54, and a pair of electrically conductive leaves 67 hingedly attached by hinges 77 to an underside of area 71 of flexible cover 69. An example of a type of hinge used is a spring hinge. As an exterior surface of area 71 above leaves 67, is pressed down upon, the leaves 67 bend upwards and come into contact with each other and with contact pads 54, electrically connecting contact pads 54 to each other. This closes the open electrical circuit thereby activating the light 13, which forwardly directs light beam 15. Again, when contact pads 54 are in an electrically connected position relative to each other, the circuit is closed and the light is activated. When contact pads 54 are in an electrically non-connected position in relative to each other, the circuit is open and the light is inactive.

As pictured in FIG. 8, the cover 69 may include tangs 73 which are inserted into openings (not shown) within the body 16 so as to attach the cover 69 to the body 16 of the plug 11.

What is claimed is:

1. An electrical plug comprising, a body and prongs for plugging into a socket, and a circuit board within said body having, a battery, a light source projecting a beam of light between said prongs and electrically powered by the battery, a switch disposed for controlling electrical power between the battery and the light source, the switch having electrical contacts mounted on the circuit board.

2. The electrical plug of claim 1 wherein said switch further includes a spring connected to a push button wherein when said push button is pressed said spring is pushed down and electrically connects said contact pads to each other.

3. The electrical plug of claim 1 wherein said battery is a 3 volt battery.

4. The electrical plug of claim 1 further comprising a second battery.

5. The electrical plug of claim 1 further comprising a curved indented bottom surface.

6. The electrical plug of claim 1 wherein said switch further includes, a cover of said body having an exterior surface and an underside, and a pair of electrically conductive leaves hingedly connected to said underside and beneath said exterior surface wherein when said exterior surface above said leaves is pressed said leaves move upward and electrically connect said contacts pads to each other.

7. The electrical plug of claim 6 wherein said cover is flexible.

8. The electrical plug of claim 1 wherein said body further includes a cavity wherein said circuit board is nested within said cavity.

9. The electrical plug of claim 8 further comprising a cover for said body covering said cavity.

10. The electrical plug of claim 1 wherein said body further comprises a front surface, an internal section having a top surface, and a notch extending from a front portion of said top surface and an upper portion of said front surface.

11. The electrical plug of claim 10 further comprising a cover including a notch substantially equivalent in size to a portion of the notch extending from the front portion of said top surface.

12. The electrical plug of claim 10 further comprising a lens fitting over said notch.

13. An electrical plug comprising, a body and prongs for plugging into a socket, a cavity within said body, and a circuit board nested within said cavity of said body having, a battery, a light source projecting a beam of light between said prongs and electrically powered by the battery, a switch disposed for controlling electrical power between the battery and the light source, the switch having electrical contacts mounted on the circuit board.

* * * * *